US011668456B2

(12) United States Patent
Sonneman et al.

(10) Patent No.: US 11,668,456 B2
(45) Date of Patent: Jun. 6, 2023

(54) LIGHTING SYSTEM

(71) Applicant: Contemporary Visions, LLC, Larchmont, NY (US)

(72) Inventors: Robert A. Sonneman, Mamaroneck, NY (US); Nuno Pires Da Silva, Lisbon (PT)

( * ) Notice: Subject to any disclaimer, the term of this patent is extended or adjusted under 35 U.S.C. 154(b) by 0 days.

(21) Appl. No.: 17/678,678

(22) Filed: Feb. 23, 2022

(65) Prior Publication Data

US 2022/0282860 A1 Sep. 8, 2022

Related U.S. Application Data

(60) Provisional application No. 63/199,402, filed on Dec. 23, 2020.

(51) Int. Cl.
*F21V 23/06* (2006.01)
*F21S 4/28* (2016.01)

(52) U.S. Cl.
CPC ..... *F21V 23/06* (2013.01); *F21S 4/28* (2016.01)

(58) Field of Classification Search
CPC ..... F21V 2/00–005; F21V 19/008–009; F21S 2/00–005
See application file for complete search history.

(56) References Cited

U.S. PATENT DOCUMENTS 4,687,292 A 8/1987 Krausse
4,799,134 A * 1/1989 Pinch ..... F21V 7/16 362/217.08
5,904,415 A 5/1999 Robertson et al.
6,179,480 B1 1/2001 Bella et al.
6,193,939 B1 2/2001 Kozlowski
6,547,412 B2 4/2003 Piparo-Haase et al.
7,052,171 B1 5/2006 Lefebvre et al.
7,473,006 B1 1/2009 Bollman
8,322,890 B2 12/2012 Pabst et al.
8,523,394 B2 9/2013 Simon et al.
8,579,463 B2 11/2013 Clough
8,678,610 B2 3/2014 Simon et al.
8,803,426 B2 8/2014 Carlin et al.
8,905,574 B2 12/2014 Li et al.
9,046,256 B2 6/2015 Szprengiel et al.
(Continued)

FOREIGN PATENT DOCUMENTS

CA 2217167 A1 * 6/1997
CN 202791855 3/2013
(Continued)

OTHER PUBLICATIONS

Lemo SA, How to choose High Quality LED Tube?, Oct. 10, 2013, https://www.lemo.com/catalog/ROW/UK_English/T_series_en.pdf, last visited Aug. 17, 2022.
(Continued)

*Primary Examiner* — Anabel Ton
(74) *Attorney, Agent, or Firm* — Gottlieb, Rackman & Reisman, PC

(57) ABSTRACT

A modular lighting system that includes at one cylindrical luminaire that includes a power contact on at least one end that is contacted by a connector from which pins extend to transfer power. The lighting system can be mounted on a ceiling, wall or both at the same time with the luminaire being rotatable and the system being scalable.

12 Claims, 10 Drawing Sheets

(56) References Cited

U.S. PATENT DOCUMENTS

| | | | | |
|---|---|---|---|---|
| 10,151,467 | B2 | 12/2018 | Xu et al. | |
| 10,267,500 | B2 | 4/2019 | He et al. | |
| 10,415,814 | B2 | 9/2019 | Kay et al. | |
| 10,515,745 | B2 | 12/2019 | Nakamura | |
| 2002/0106931 | A1 | 8/2002 | Hsien-Te | |
| 2009/0196029 | A1* | 8/2009 | Kurtz | F21V 19/008 313/631 |
| 2014/0036505 | A1 | 2/2014 | Barton | |
| 2015/0126059 | A1 | 5/2015 | Zhao | |
| 2016/0356433 | A1 | 12/2016 | Xu | |
| 2020/0041103 | A1* | 2/2020 | Germain | F21S 2/00 |

FOREIGN PATENT DOCUMENTS

| | | | | |
|---|---|---|---|---|
| EP | 0010507 | | 4/1980 | |
| EP | 0303561 | A2 * | 2/1989 | |
| FR | 2675958 | A1 * | 10/1992 | F21V 19/0085 |
| KR | 20100009789 | | 10/2010 | |
| KR | 20160024566 | | 3/2016 | |

OTHER PUBLICATIONS

InstantFit T8 LED Tube, https://compatibleledtube.blogspot.com/2013/10/how-to-choose-high-quality-led-tube.html, last visited Aug. 17, 2022.

Juniper Design Group, Inc., Thin Modular Lighting System, 2020, https://juniper-design.com/thin-modular-lighting-system/, last visited Aug. 17, 2022.

* cited by examiner

LIGHTING SYSTEM

CROSS-REFERENCE TO RELATED APPLICATION

This patent application claims benefit to U.S. Provisional Patent Application No. 63/199,402, filed Dec. 23, 2020, which is hereby incorporated by reference in its entirety as part of the present disclosure.

FIELD OF THE INVENTION

This present disclosure relates generally to a luminaire and more specifically to a scalable modular lighting system that that is configured to be mounted to a surface (e.g., wall, ceiling, a combination thereof or a similar structure) and that can include a plurality of luminaires adjoined to each other by connecters that allows for an infinite variety of lighting configurations.

BACKGROUND OF THE INVENTION

Known modular lighting system come in various shapes and configurations ranging from a single lighting fixture to multiple lighting fixtures that are affixable to a surface (e.g., ceiling, wall or similar structure). However, such modular lighting systems do not allow for seamless and continuous electro-mechanical connectivity between luminaires that can be configured to be an array of possible arrangements.

SUMMARY OF THE INVENTION

In general, the present disclosure is directed to a modular lighting system that are fixable to a surface or multiple surfaces (e.g., wall and ceiling) comprising one or more tubular luminaires and can be adjoined to each other or similar structures by connectors to form a variety of scalable arrangements that project light therefrom. The connectors include electrical projections or pins that extend therefrom and interact with a contact surface of the luminaire to provide power to the luminaire and allow for rotation of the luminaire with respect to the connector.

DETAILED DESCRIPTION OF EMBODIMENTS OF THE INVENTION

With reference now to the drawings, embodiments of a lighting system and elements thereof embodying the principles and concepts of the present invention will be described.

The lighting system includes one or more luminaires that is/are arranged between surface-mounted connectors and rotatable with respect to the connectors to direct light from the luminaire(s) at a desired angle (e.g., toward a wall, ceiling, etc.). The system is scalable such that the as few as a single luminaire and two connectors can be utilized or a plurality of luminaires and a plurality of connectors can be utilized to form the lighting system.

Figure 1:
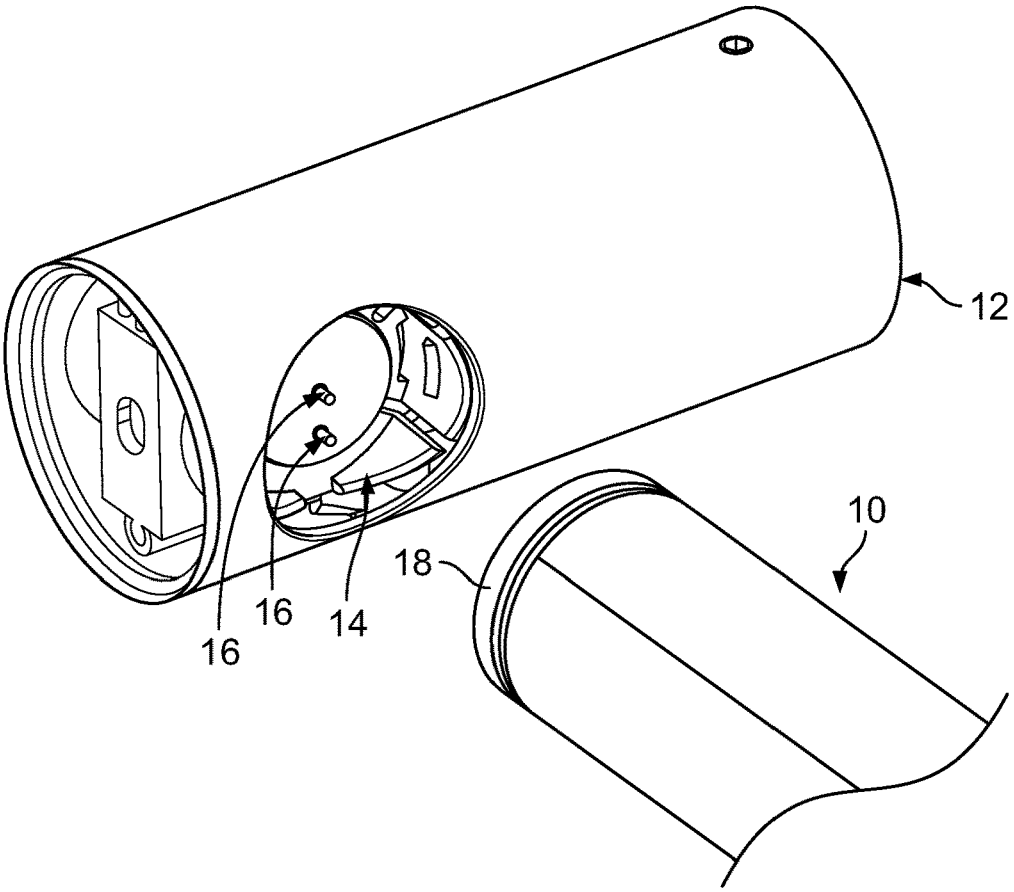
FIGS. 1 and 2 are assembly views of a luminaire and connector according to an exemplary embodiment of the present disclosure.
Figure 2:
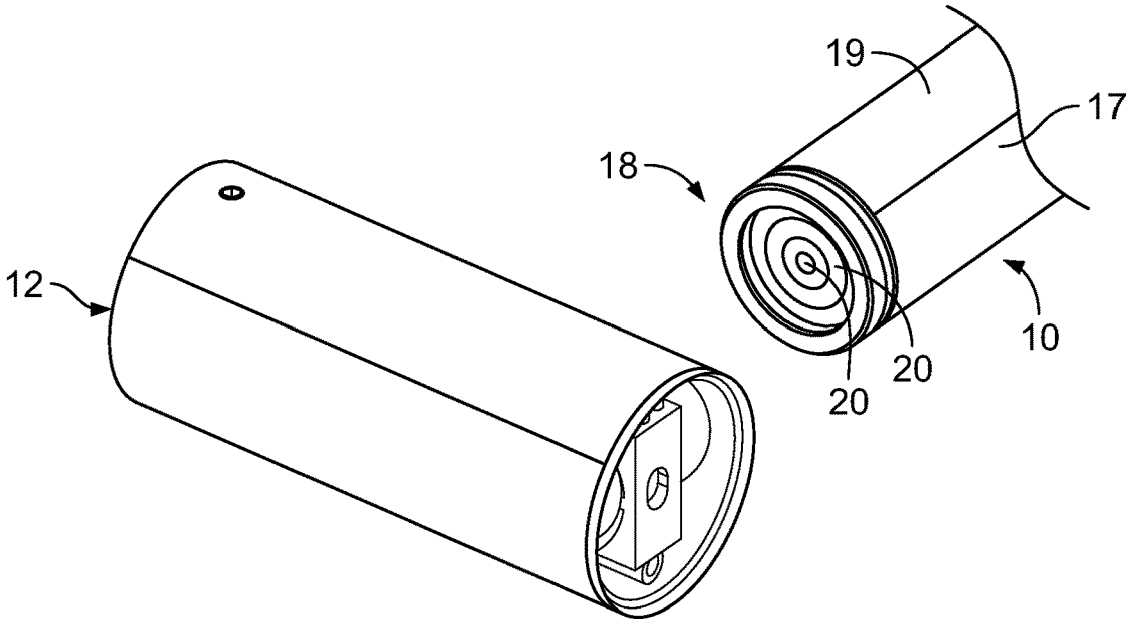

FIGS. 1 and 2 illustrate an assembly of a cylindrical luminaire 10 and a connector 12. The connector 12 includes an opening 14 from which contacts 16, which are spring pins, extend. As depicted in FIG. 2, the luminaire 10 includes a housing 17 that is delimited by recessed ends 18 that are configured to interact with the structure within the opening(s) 14 of the connector 12 and a surface 20 of a printed circuit board or the like that is configured to receive the contacts 16 so that power can be transferred from the connector 12 to the luminaire 10 to illuminate the luminaire 10. As part of the housing 102, the luminaire 10 includes a panel 104 that is in part is at least one of opaque, transparent, or the like to allow light from light sources 22 (See FIG. 4) project outward.

Figure 3:
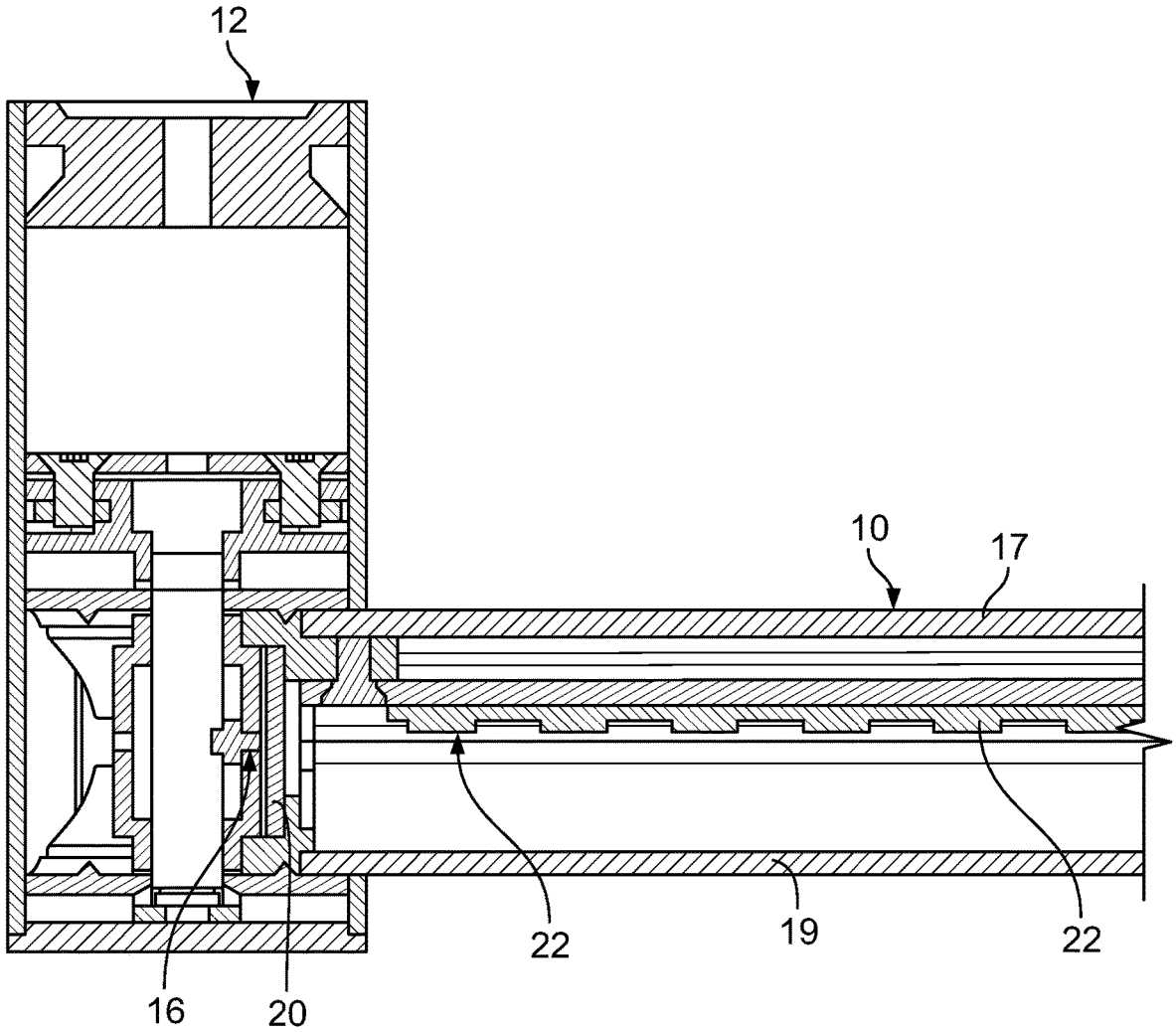
FIGS. 3 and 4 are cross-sectional views of a luminaire in an assembled state with a connector according to an exemplary embodiment of the present disclosure.
Figure 4:
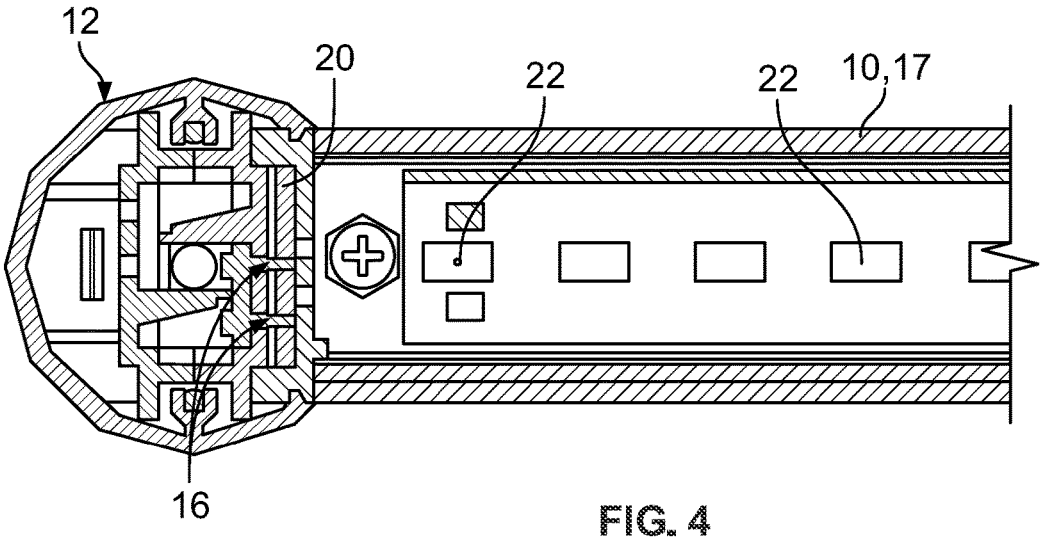

FIGS. 3 and 4 are cross-sectional views of the luminaire 10 and connector 12 in an assembled state. As shown, and end of the luminaire 10 is arranged in the opening 14 of the connector 12 and the spring pins 16 that extend from the connector 12 are in contact with the surface 20 of the luminaire. The luminaire 10 includes a plurality of light sources (LEDs) 22 that are configured to be illuminated upon power being provided thereto.

Figure 5:
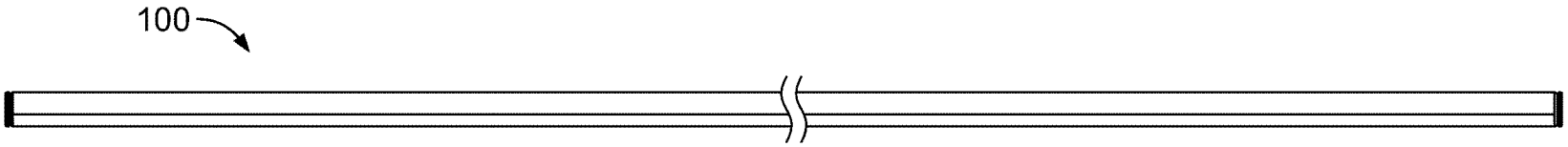
FIG. 5 is a side view of a luminaire according to an exemplary embodiment of the present disclosure.

FIG. 5 depicts an exemplary embodiment of a luminaire 100 that can be utilized in conjunction with connectors to form a lighting system.

Figure 6:
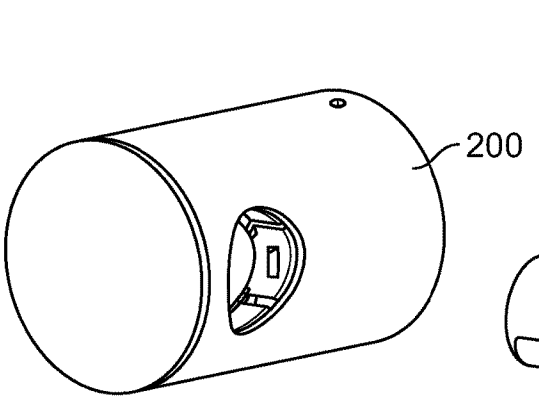
FIG. 6 is a perspective view of an end connector according to an exemplary embodiment of the present disclosure.
Figure 7A:
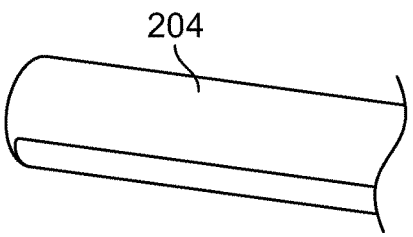
FIGS. 7A and 7B are assembly views of the end connector of FIG. 6 and a luminaire according to an exemplary embodiment of the present disclosure.
Figure 7B:
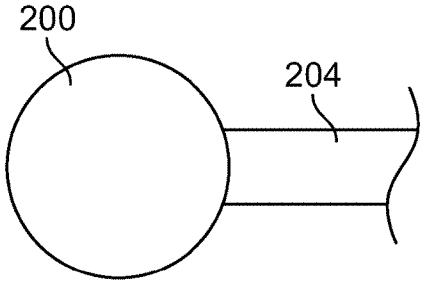
Figure 8B:
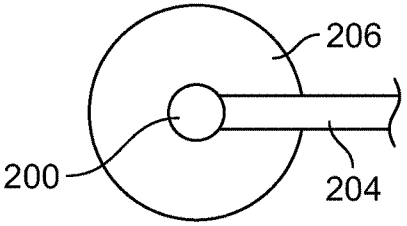
FIGS. 8A and 8B is a perspective view of an end connector and a canopy or end cap according to an exemplary embodiment of the present disclosure.
Figure 8A:
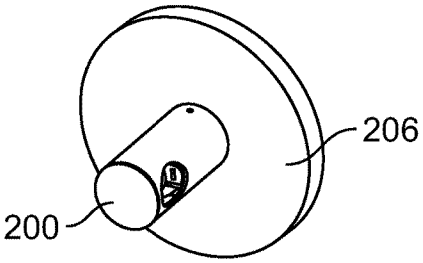

FIG. 6 illustrates an end connector 200 that includes a single opening 202 that has contacts (spring pins) that are configured to interact with a luminaire. FIGS. 7A and 7B show the assembly of the connector 200 with a luminaire 204 and FIG. 8 shows a canopy or end cap 206 for added decorative purposes encompassing a distal end of the connector 200 and configured to connect a surface.

Figure 10B:
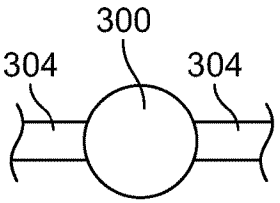
FIGS. 10A and 10B are assembly views of the linear connector of FIG. 9 and a luminaire according to an exemplary embodiment of the present disclosure.
Figure 10A:
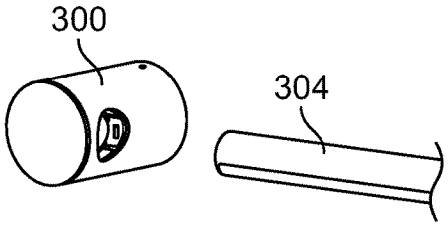
Figure 9:
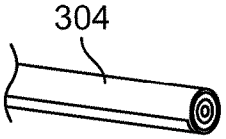
FIG. 9 is a perspective view of a linear connector according to an exemplary embodiment of the present disclosure.
Figure 9:
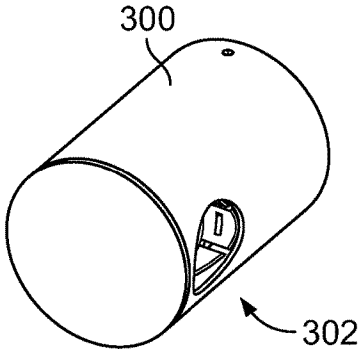
Figure 11B:
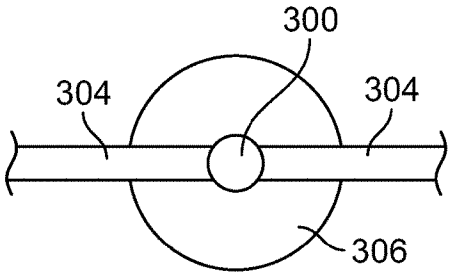
FIGS. 11A and 11B is a perspective view of a linear connector and a canopy or end cap according to an exemplary embodiment of the present disclosure.
Figure 11A:
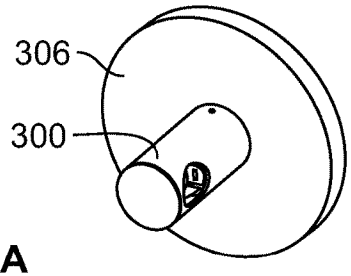

FIG. 9 illustrates a linear connector 300 that includes two opening 302 that have contacts (spring pins) therein that are configured to interact with luminaires. FIGS. 10A and 10B show the assembly of the connector 300 and luminaires 304 and FIGS. 11A-11B show a canopy or end cap 306 for added decorative purposes encompassing a distal end of the connector 300 that is configured to connect a surface.

Figure 13A:
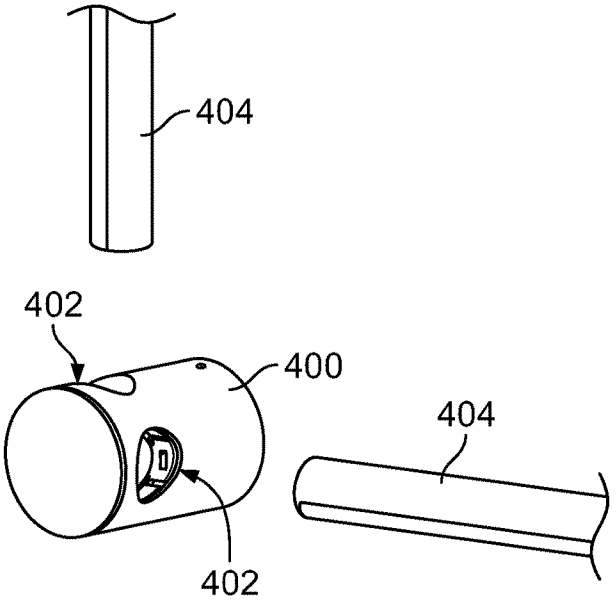
FIGS. 13A and 13B are assembly views of the corner connector of FIG. 12 and a luminaire according to an exemplary embodiment of the present disclosure.
Figure 13B:
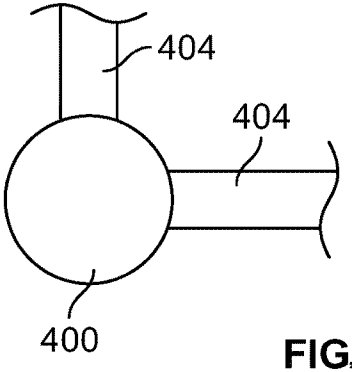
Figure 12:
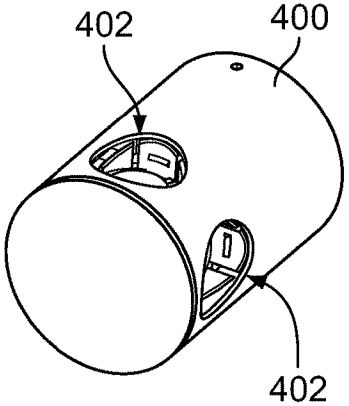
FIG. 12 is a perspective view of a corner connector according to an exemplary embodiment of the present disclosure.

FIG. 12 illustrates a corner connector 400 that includes two opening 402 that have contacts (spring pins) therein that are configured to interact with luminaires 404. FIGS. 13A and 13B show the assembly of the connector 400 and the luminaires 404. As can be seen in an assembled state, the luminaires 404 are orientated at about 90 degrees with respect to each other by the connector 400.

Figure 15A:
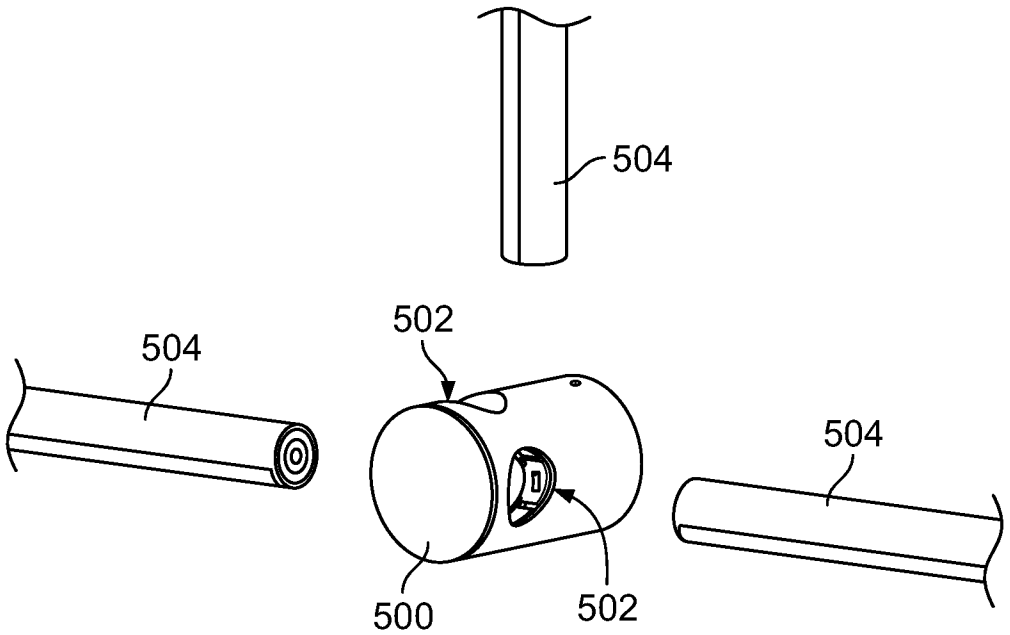
FIGS. 15A and 15B are assembly views of the T-shaped corner connector of FIG. 14 and a luminaire according to an exemplary embodiment of the present disclosure.
Figure 15B:
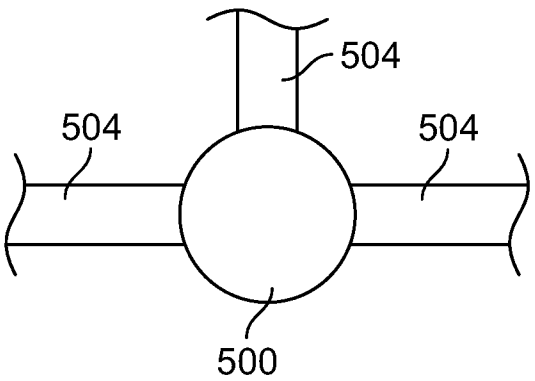
Figure 14:
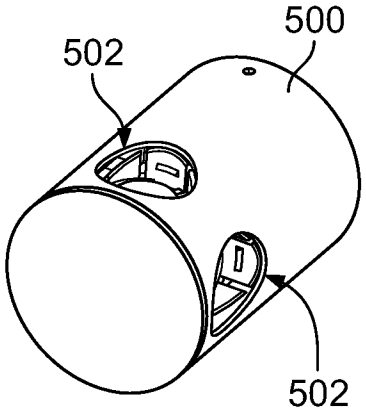
FIG. 14 is a perspective view of a T-shaped connector according to an exemplary embodiment of the present disclosure.

FIG. 14 illustrates a T-shaped connector 500 that includes three opening 502 that have contacts (spring pins) therein that are configured to interact with luminaires 504. FIGS. 15A and 15B show the assembly of the connector 500 and the luminaires 504. As can be seen in an assembled state, the luminaires 504 are orientated at about 90 degrees with respect to each other by the connector 500 to form a T-shape.

Figure 16:
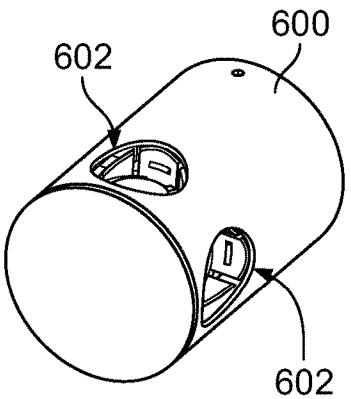
FIG. 16 is a perspective view of a X-shaped connector according to an exemplary embodiment of the present disclosure.
Figure 17B:
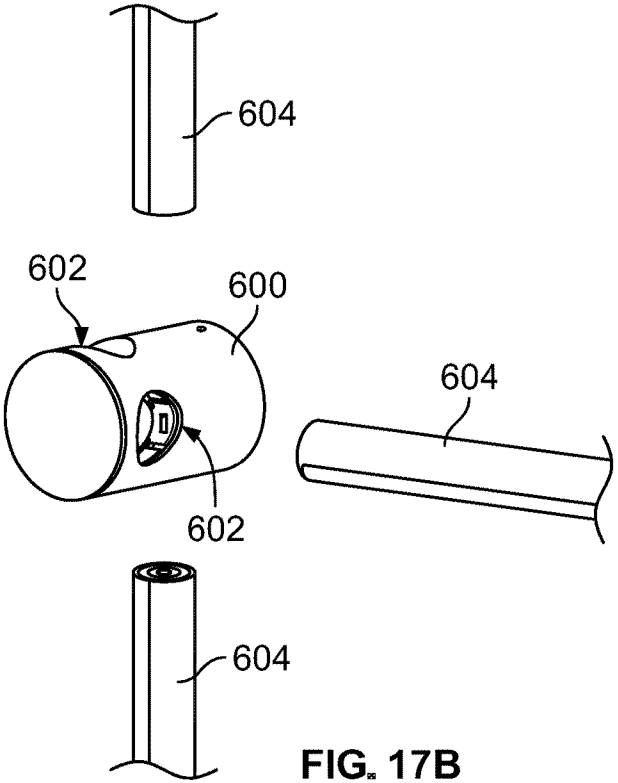
FIGS. 17A and 17B are assembly views of the X-shaped corner connector of FIG. 16 and a luminaire according to an exemplary embodiment of the present disclosure.
Figure 17A:
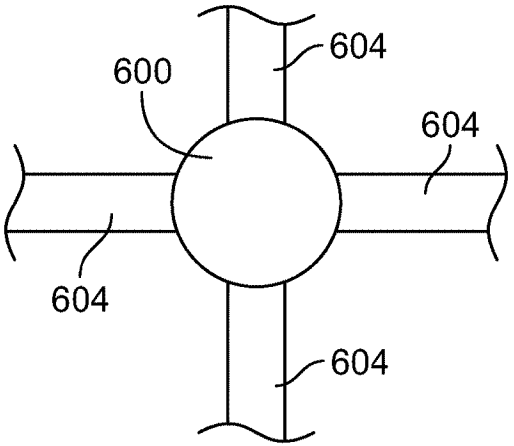

FIG. 16 illustrates a X-shaped connector 600 that includes three opening 602 that have contacts (spring pins) therein that are configured to interact with luminaires 604. FIGS. 17A and 17B show the assembly of the connector 600 and the luminaires 604. As can be seen in an assembled state, the luminaires 604 are orientated at about 90 degrees with respect to each other by the connector 600 to form a X-shape.

Figure 18:
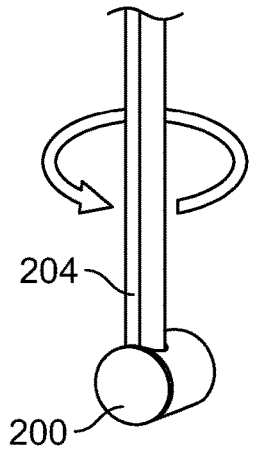
FIG. 18 is a perspective view of a luminaire in an assembled state with a connector and being indicated as rotatable with respect to the connector.
Figure 19:
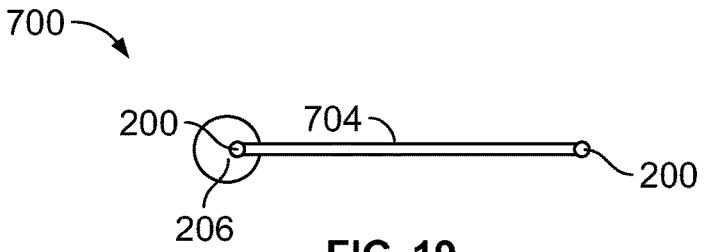
FIGS. 19-23 are various views of lighting systems that incorporate at least one cylindrical luminaire and at least one connector according to exemplary embodiments of the present disclosure.
Figure 20:
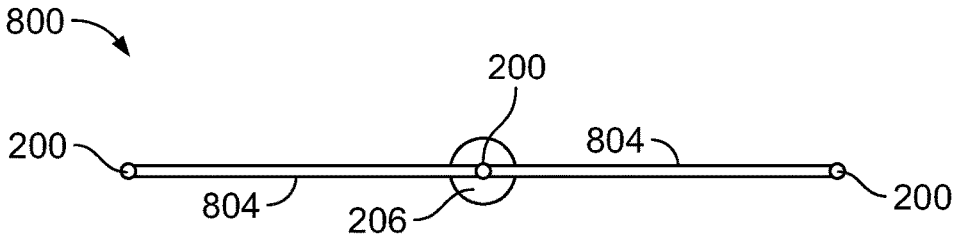
Figure 21:
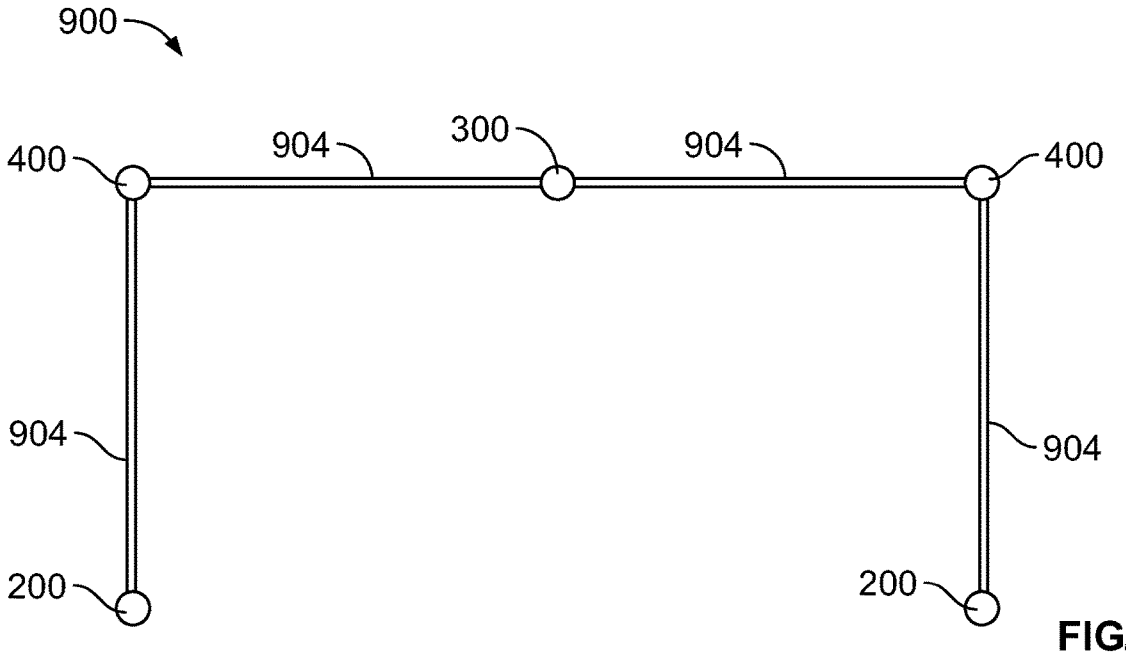
Figure 23:
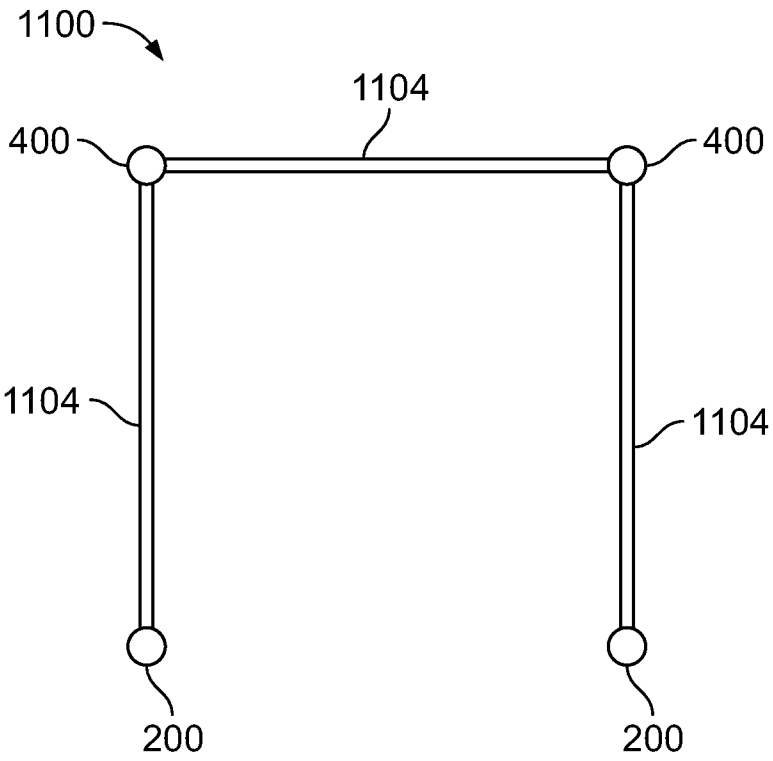
Figure 22:
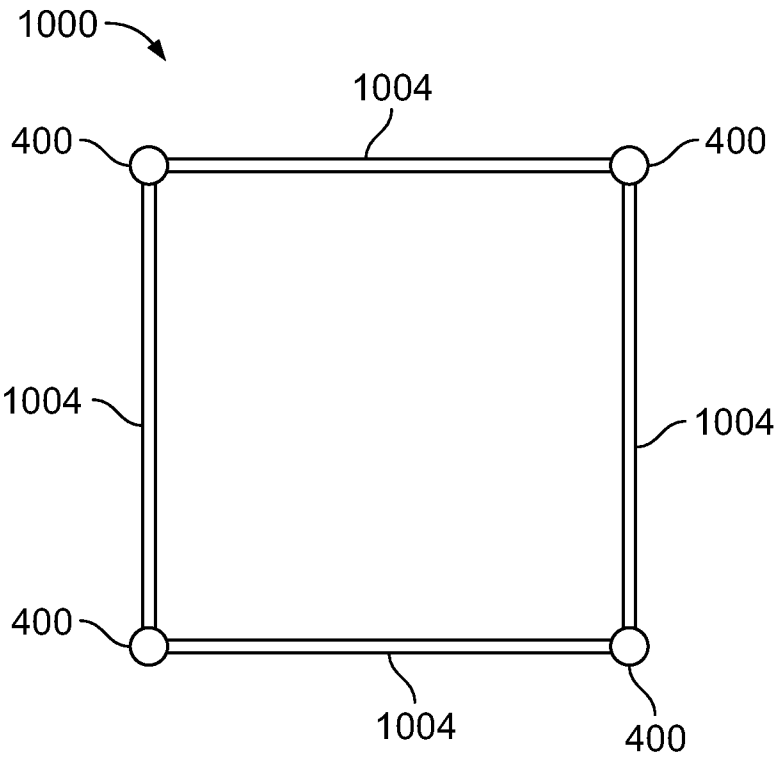

FIG. 18 illustrates a luminaire 204 that is rotatable with respect to the connector 200 in an assembled state.

FIGS. 19-23 illustrate exemplary embodiments of lighting systems 700, 800, 900, 1000, 1100 that are comprised of at least one luminaire 704, 804, 904, 1004, 1104, respectively, and two connectors to delimit each luminaire at each end thereof.

Figure 24:
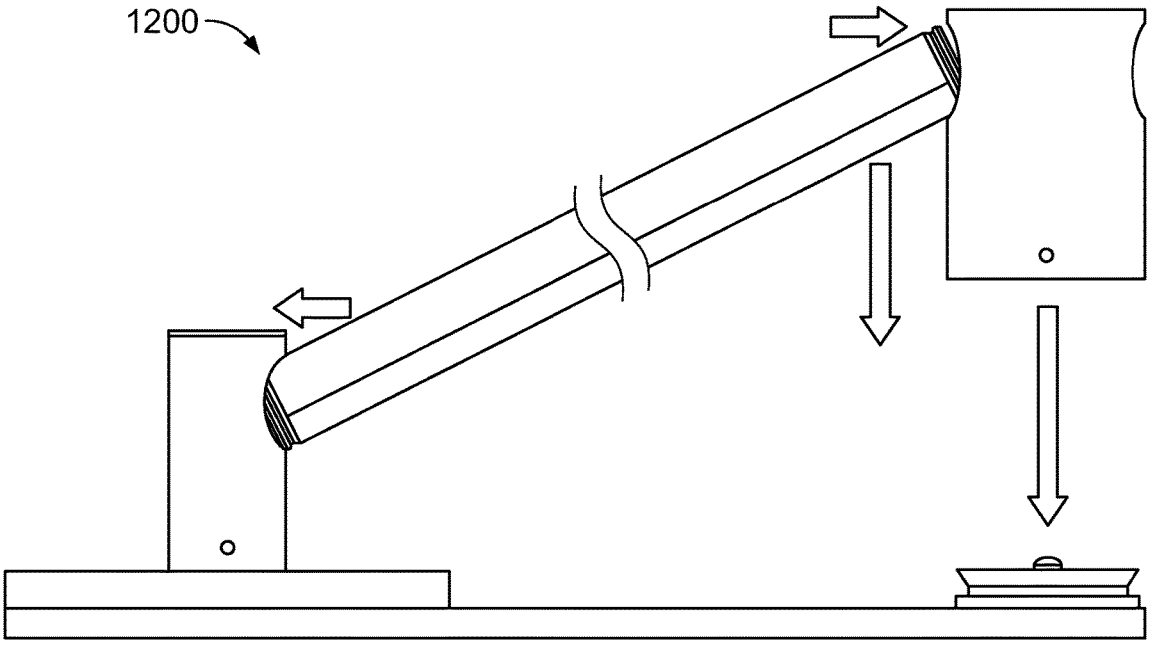
FIGS. 24 and 25 are assembly views of at least one cylindrical luminaire and connectors according to exemplary embodiments of the present disclosure.
Figure 25:
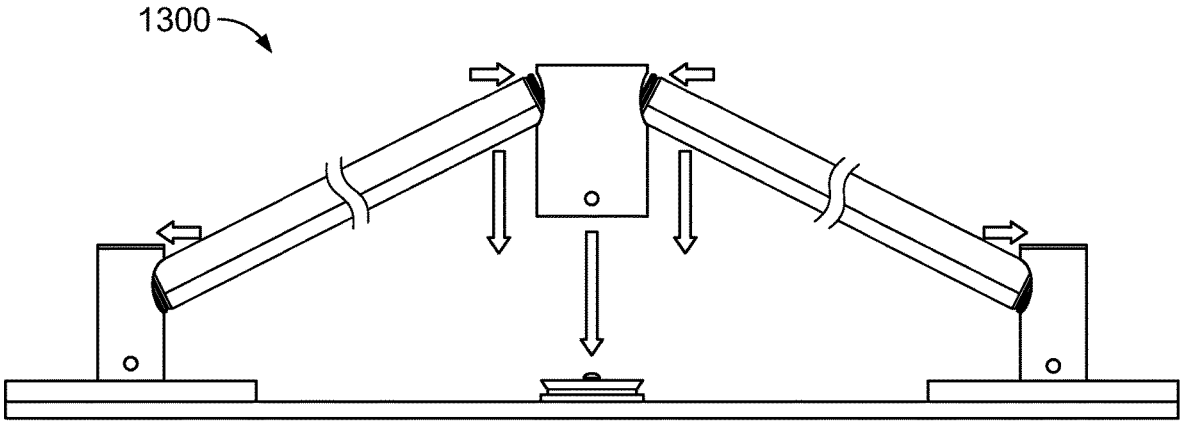

FIGS. 24 and 25 are assembly views 1200, 1300 of lighting systems. The mounting brackets of the connectors are fixed to a surface by, for example, a fastener. Next one end of a luminaire is placed in an opening of a connector and then the other end of the luminaire is placed in an opening of another connector. The connectors are then secured to the mounting brackets.

Although the description above and accompanying drawings contains much specificity, the details provided should not be construed as limiting the scope of the embodiments, but merely as describing some of the features of the embodiments. The description and figures should not to be taken as restrictive and are understood as broad and general teachings in accordance with the present invention. While the embodiments have been described using specific terms, such description is for illustrative purposes only, and it is to be understood that modifications and variations to such embodiments, including, but not limited to, the substitutions of equivalent features and terminology may be readily apparent to those of skill in the art based upon this disclosure without departing from the spirit and scope of the invention.

What is claimed is:

1. A lighting system, comprising:

at least one cylindrical luminaire having a housing that is delimited at a first end and a second end thereof, the first end of the housing having a recessed opening and the second end having a recessed opening, an electrical contact surface being arranged within the recessed opening of at least one of the first end of the housing and the second end of the housing; and at least one connector having at least one recessed opening in which electrical projections extend therefrom, the electrical projections being configured to interact with and extend into the electrical contact surface to both transfer power and secure the luminaire to a surface with the at least one of the first end and the second end of the housing extending within the recessed opening of the at least one connector.

2. The lighting system of claim 1, wherein the electrical projections are spring pins.

3. The lighting system of claim 1, wherein the at least one connector includes a first connector and a second connector.

4. The lighting system of claim 3, wherein the at least one luminaire arranged between the first connector and the second connector with the first end of the at least one cylindrical luminaire arranged within the recessed opening of the first connector and the second end of the at least one cylindrical luminaire arranged within the recessed opening of the second connector.

5. The lighting system of claim 1, wherein the electrical contact surface is located at the first end and at the second end of the at least one luminaire.

6. The lighting system of claim 1, wherein the electrical contact surface is a printed circuit board.

7. The lighting system of claim 1, wherein the electrical contact surface is arranged within the recessed opening of the first end of the housing and a second electrical contact is arranged within the recessed opening of the second end of the housing.

8. The lighting system of claim 1, wherein the at least one cylindrical luminaire is rotatable with respect to the at least one connector.

9. The lighting system of claim 1, wherein the at least one cylindrical luminaire includes a housing that has a panel that permits light to transfer therethrough.

10. The lighting system of claim 8, wherein the at least one luminaire includes a plurality of light sources arranged within the housing.

11. The lighting system of claim 1, wherein the housing is delimited between a first end and a second end with a first recess extending from the first end toward the second end and a second recess extending at the second end towards the first end.

12. The lighting system of claim 1, wherein the recessed opening includes a projection extending therein, which, in an assembled state with the at least one cylindrical opening interacts with and is arranged within the recessed opening of one of the first end and the second end of the housing.

* * * * *